US006076191A

United States Patent [19]

Kapas

[11] Patent Number: 6,076,191

[45] Date of Patent: Jun. 20, 2000

[54] ROTATIONAL HAT

[76] Inventor: James A. Kapas, 566 Knickerbocker Rd., Ridgewood, N.J. 07450

[21] Appl. No.: 09/288,009

[22] Filed: Apr. 8, 1999

[51] Int. Cl.[7] ..... A42B 1/00

[52] U.S. Cl. ..... 2/171.02; 2/209.13

[58] Field of Search ..... 2/171.02, 209.13, 2/171, 171.3

[56] References Cited

U.S. PATENT DOCUMENTS

| | | | |
|---|---|---|---|
| 103,457 | 5/1870 | Heard . | |
| D. 155,437 | 10/1949 | Molin et al. . | |
| D. 264,016 | 4/1982 | Fournier . | |
| 2,958,156 | 11/1960 | Schmahl et al. . | |
| 3,182,422 | 5/1965 | Ryan . | |
| 3,391,407 | 7/1968 | Waters . | |
| 3,399,486 | 9/1968 | Bogaart . | |
| 3,452,364 | 7/1969 | Langston | 223/171.02 |
| 4,488,372 | 12/1984 | Lowen . | |
| 5,088,127 | 2/1992 | Thornock . | |
| 5,243,707 | 9/1993 | Bodinet . | |

*Primary Examiner*—Bibhu Mohanty
*Attorney, Agent, or Firm*—Weingram & Associates, P.C.

[57] ABSTRACT

An ornamental rotational hat is provided which includes a cap portion having an interior space for receiving a wearer's head, a motor mounted to the cap portion, and a screw-shaped ornament connected to the motor to rotate with respect to the cap while the cap remains stationary on the wearer's head. An additional feature of the rotational hat calls for an insert for the cap having a plurality of fingers with inherent resiliency to grip a head of the wearer, and to retain the cap to the wearer's head during rotation of the ornament.

12 Claims, 1 Drawing Sheet

ROTATIONAL HAT

BACKGROUND OF THE INVENTION

1. Field of the Invention

The present invention relates to headwear which have a motorized rotational feature, and which have head gripping regions to help conform an interior of the headwear to the wearer's head especially during rotation of the motorized feature.

2. Description of the Related Art

Novelty hats and helmets are known which have objects mounted thereto for rotation with respect to the headwear, and include:

| U.S. Pat. No. | Inventor(s) |
|---|---|
| 103,457 | Heard |
| 2,958,156 | Schmahl et al |
| 3,182,422 | Ryan |
| 3,391,407 | Waters |
| 3,399,486 | Bogaart |
| 4,488,372 | Lowen |
| 5,088,127 | Thornock |
| 5,243,707 | Bodinet |
| Des155,437 | Molin et al |
| Des264,016 | Fournier |

U.S. Pat. No. 103,457 to Heard discloses a hat formed of a wide lower truncated cone supported by stays extending from a head band to allow ventilation of the head of the wearer. An upper smaller closed cone is supported by stays extending from the lower cone and is spaced above the lower cone to permit air circulation to keep the head cool.

U.S. Pat. No. 2,958,156 to Schmahl et al discloses a hat having a vertical stem extending above the hat. The stem has a rounded seat supporting a hollow sphere or ball containing a flexible cord wound on a spring biased spool. One end of the cord is secured in the vertical stem seat. Movement of the head causes the cord to unwind and spin the ball about the hat. The spring causes the cord to be rewound when not moving the head.

U.S. Pat. No. 3,182,422 to Ryan discloses a cap having a vertically extending shaft supporting a rotatable propeller ring. A spring biased latch and rotary drive engage the propeller. A cord connected to the latch extends under the jaw of the wearer so that movement of the jaw releases the latch and launches the propeller.

U.S. Pat. No. 3,391,407 to Waters discloses an air cooled helmet having a battery operated fan inside the dome of the helmet. A screen supports a cooling pad below the fan with cool air directed down over the head, neck and shoulders of the wearer.

U.S. Pat. No. 3,399,486 to Bogaart discloses a rotary hat mounted on a vertical shaft extending from strap fitting over the head and under the chin of the wearer. A cone shaped hat rotates on a pivot assembly mounted on the shaft. Wind vanes on the hat cause rotation when wind blows against the hat. The hat shape can take varied forms.

U.S. Pat. No. 4,488,372 to Lowen discloses a head mounted motor driven horizontal bar with lightweight fluffy balls at each end which rotate about a central shaft. A head clasp supports the device.

U.S. Pat. No. 5,088,127 to Thornock discloses a cap with vertically mounted miniature electric motor which rotates a placard above the cap. A photovoltaic panel on the top surface of the front peak of the cap is connected to and provides power to the motor when a source of light energizes the panel.

U.S. Pat. No. 5,243,707 to Bodinet discloses an inflatable hat formed of gas impermeable plastic sheets that can take various shapes. Two sheets of plastic are heat sealed along the edges to leave a small entry point for a tube to insert air or gas into the space between sheets.

U.S. Pat. No. Des. 155,437 to Molin et al discloses an ornamental cap having two spaced propeller blades rotatable about a vertical central shaft extending above the cap. A larger blade is in a lower position and a smaller blade in an upper position.

U.S. Pat. No. Des. 264,016 to Fournier discloses a detachable head band having a small horizontally mounted fan extending outwardly from a vertical raised portion of the head band.

However, among the devices disclosed in the patents identified above, known disclose a screw-shaped ornament mounted on top of a cap, the structure being selectively and mechanically rotatable to simulate the screw being threaded in the air above the cap. Many of the devices in the patents discussed above are wind powered and therefore, under calm conditions, the rotational devices are immovable.

The present invention is also provided with a head hugging feature in the cap to retain the cap on the wearer's head during the rotational movement of the screw ornament of the present invention.

OBJECTS AND SUMMARY OF THE INVENTION

It is an object of the present invention to provide a head covering constructed as a cap which has a rotatable screw ornament disposed thereon for rotational movement with respect to the cap.

It is another object of the present invention to provide a rotational hat wherein the user selectively actuates the rotation of the screw-shaped ornament and the speed of the rotation.

It is another object of the present invention to provide a rotational hat having an insert with an inherent resiliency mounted in the cap portion which snugs the cap portion to the wearer's head.

It is another object of the present invention to provide a 10 rotational hat having a battery operated motor mounted therein for which the batteries are easily replaceable.

It is another object of the present invention to provide a rotational hat wherein the motor can be actuated from an exterior switch of the hat.

It is another object of the present invention to provide a rotational hat having a head-hugging feature to retain the hat on the wearer's head even when the person's head is tilted through angles of arc or from side to side.

BRIEF DESCRIPTION OF THE DRAWINGS

For a more complete understanding of the present invention, reference may be had to the following description of exemplary embodiments of the present invention considered in connection with the accompanying drawings, of which.

DETAILED DESCRIPTION OF THE PREFERRED EMBODIMENTS

The rotational hat according to the present invention is shown generally at 10.

Figure 1:
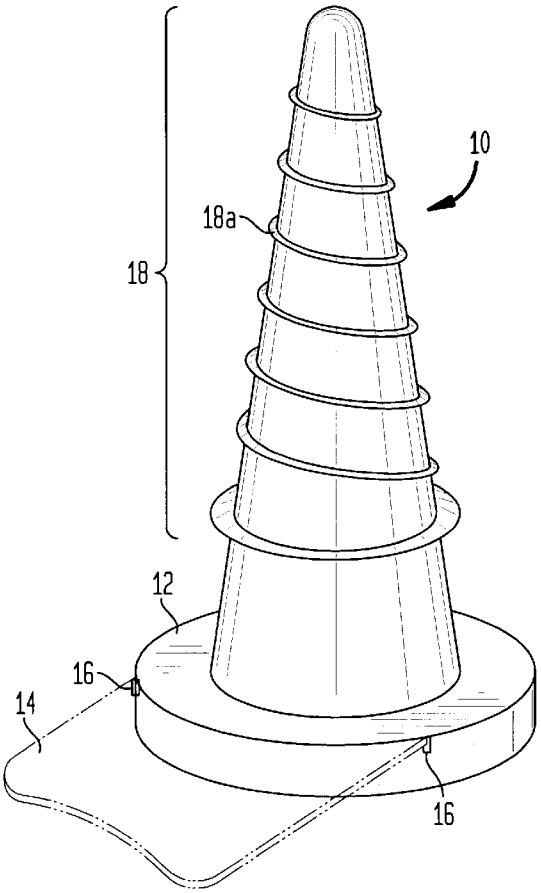
FIG. 1 is a top perspective view of the rotational hat according to the present invention.

Referring to FIG. 1, the rotational hat includes a cap portion 12 from which a visor 14 can be releasably mounted thereto, by way of known mechanical fasteners 16. Extending from the top of the cap is a threaded shank 18 representing a screw-shaped ornament, such as a wood screw.

The material from which the hat 10 is manufactured can include any number of known fabrics for the cap 12, visor 14 and screw 18 portions. The visor 14 can also be constructed from a transparent material having a shaded filter portion therein.

A thread 18*a* for the screw 18 can be made in contrasting or fluorescent colors for being readily distinguishable, especially during the rotation of the screw ornament 18 as will be discussed hereinafter.

Figure 2:
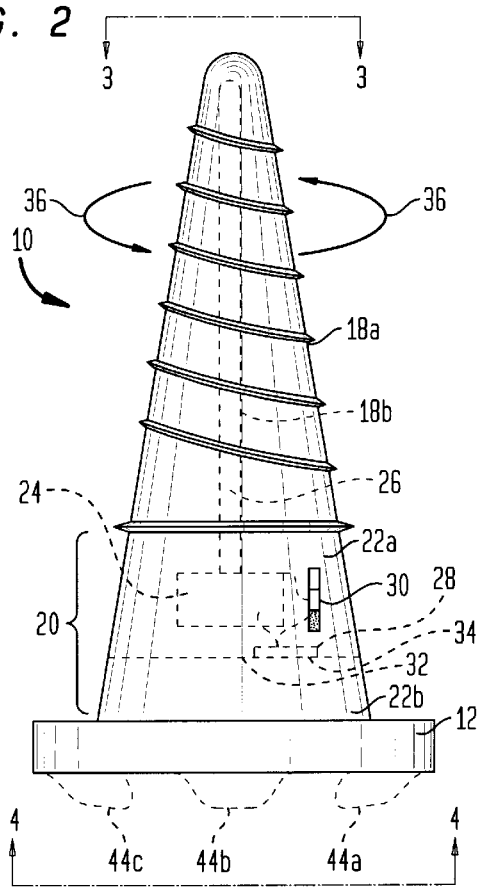
FIG. 2 is a side elevational view showing elements of the rotational hat according to the present invention.

Referring also to FIG. 2, a motor housing 20 is provided at the top of the cap 12 to support the screw 18 thereon. The motor housing 20 includes an upper interior chamber 22*a* in which a motor 24 is mounted, and a lower interior chamber 22*b*. The motor 24 has a shaft 26 extending therefrom upward into a slot 18*b* of the screw portion 18, and is fixedly connected to the screw portion. The motor 24 is powered by a power means which consists of a battery 28 which is accessible at the motor housing 20. The motor can operate at one or a plurality of different speeds. The motor housing 22 is also provided with a switch 30 accessible at an exterior of the motor housing. The switch 30 interconnects the motor 24 and the battery 28, and activates the motor 24 and the speed selected for the motor 24.

As also shown in FIG. 2 an interior wall 32 of the cap 12 segregates the motor housing 20 into the upper chamber 22*a* and lower chamber 22*b*. The wall 32 insures that the wearer's head will not contact the power means 28 or the motor 24. There is an access port 34 at the wall 32 so that the batteries 28 for the power means can be replaced. The lower interior chamber 22*b* has sufficient volume to receive the upper or crown portion of the wearer's head (not shown) when it is inserted into the cap portion 12 through to the lower interior chamber.

Rotation of the screw ornament 18 is in the direction shown generally by the arrows 36, although the screw 18 can be rotated in the opposite direction.

Figure 4:
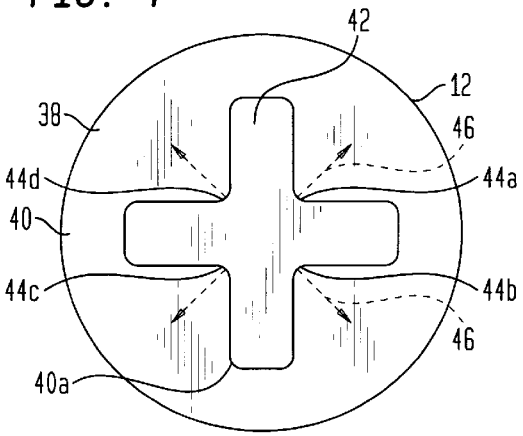
FIG. 4 is a bottom plan view of the rotational hat according to the present invention taken along lines 4—4 in FIG. 3.

The hat 10 of the present invention, especially for rotation of the screw 18, is provided with a retaining means 38 as shown with respect to FIGS. 2 and 4. The retaining means 38 is preferably formed from a foam insert 40 to be removably mounted to an interior 42 of the cap portion 12. Accordingly, the size and shape of the insert 40 conforms readily to the interior 42 of the cap so that it can be permanently mounted, or also removably mounted by way of a friction fit.

Figure 3:
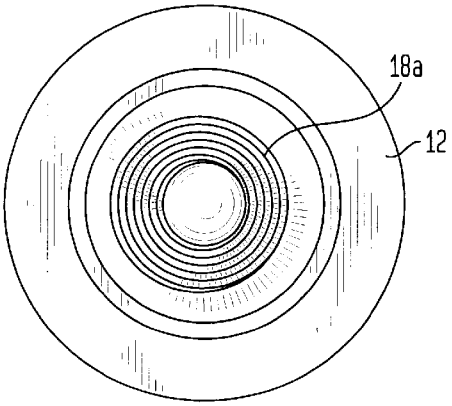
FIG. 3 is a top plan view of the rotational hat according to the present invention taken along lines 3—3 in FIG. 2.

The insert 40 is formed with a cutout 40*a* resembling a cross or x-shape as shown in FIG. 4. This construction provides for a plurality of opposing fingers 44*a–d* which, owing to the material of the insert 40, can flex to grip the wearer's head. Movement of the fingers 44*a–d* to the position shown in FIG. 3 is represented by arrows 46. Accordingly, a high density foam or rubber-like material for the insert 40 is preferred for comfort and retention to the wearer's head.

The inherent resiliency of the insert 40 permits the fingers 44*a–d* to be urged against the head for retention, and to retract under the effect of memory back into the interior 42 of the cap 12 when the hat is not worn. This permits the hat to sit upright on the cap portion 12 without tipping over.

The rotation of the screw 18 of the hat 10 can be selectively operated by the switch 30 for continuous rotation. The switch 30 is a multi-position switch so that the screw 18 can rotate at different speeds, clockwise or counterclockwise.

The hat 10 and its components can be made of any number of colors and display advertising indicia, corporate logos, or any other marks thereon. The rotation of the screw ornament 18 in the air while the motor housing 20 and cap 12 remain stationary provides for an imaginative and delightful sight.

It will be understood that the embodiments described herein are merely exemplary and that a person skilled in the art may make variations and modifications without departing from the spirit and scope of the invention. All such modifications and variations are intended to be included within the scope of the invention as defined in the appended claims.

What is claimed is:

1. A rotational hat, comprising:

a cap having a space therein for receiving a wearer's head;

a housing mounted to the cap, the housing including:

an inner wall mounted to an interior of the housing to form an upper chamber and a lower chamber in the housing separated by the inner wall, an access port in the inner wall to provide communication between the upper and lower chambers, a cover for the access port, a motor mounted for actuation in the upper chamber, the motor including a shaft extending from the motor through a top of the housing, a battery disposed in the upper chamber and accessible at the access port, a switch mounted to an exterior of the housing and interconnecting the motor and the battery for actuating the motor; and a screw-shaped ornament disposed at the top of the housing and constructed and arranged to receive the shaft extending from the motor, the screw adapted for rotational movement with respect to the cap while the cap remains stationary.

2. A rotational hat, comprising:

a cap having a space therein for receiving a wearer's head;

a housing mounted to the cap, the housing including:

an inner wall mounted to an interior of the housing to form an upper chamber and a lower chamber in the housing separated by the inner wall, an access port in the inner wall to provide communication between the upper a nd lower chambers, a cover for the access port, a motor mounted for actuation in the upper chamber, the motor including a shaft extending from the motor through a top of the housing, a battery disposed in the upper chamber and accessible at the access port, a switch mounted to an exterior of the housing and interconnecting the motor and the battery for actuating the motor;

a screw-shaped ornament disposed at the top of the housing and constructed and arranged to receive the shaft extending from the motor, the screw adapted for rotational movement with respect to the cap while the cap remains stationary; and an insert for the cap, the insert constructed from a material having an inherent resiliency and including;

a shale conforming to the space of the cap for being mounted thereto, a cutout formed in the insert at substantially a central region of the insert for receiving the wearer's head, a plurality of fingers arranged at the cutout, each one of the plurality of fingers having inherent resiliency and coacting to grip a head of the wearer when the head is inserted into the cutout, and to return to an earlier position when the head is removed from the cutout.

3. A rotational hat, comprising:

a cap portion having an interior space for receiving a wearer's head;

power means mounted to the cap portion; and a screw-shaped ornament connected to the power means for being actuated by the power means to rotate with respect to the cap portion while the cap portion remains stationary.

4. The rotational hat according to claim 3, wherein the power means comprises:

a housing mounted to the cap portion;

a motor disposed in the housing;

a shaft extending from the motor and connected to the screw-shaped ornament;

a battery connected to the motor; and a switch interconnecting the motor and the battery for selectively actuating the motor.

5. The hat according to claim 4, wherein the housing further comprises:

an inner wall providing the housing with an inner upper chamber and an inner lower chamber separated by the inner wall; and an access port in the inner wall;

wherein the upper chamber houses the motor and battery and is accessible from the lower chamber through the access port in the inner wall.

6. The hat according to claim 4, wherein the switch is accessible at an exterior of the housing.

7. The hat according to claim 3, wherein the cap portion further comprises:

a flexible insert constructed and arranged to be inserted into the interior space of the cap portion to grip the head of the wearer and retain the cap portion on the head of the wearer.

8. The hat according to claim 7, wherein the flexible insert is formed of material having an inherent resiliency to receive and grip the wearer's head, and to return to its original position when the head is removed.

9. The hat according to claim 7, wherein the flexible insert is removably mountable to the interior space of the cap portion.

10. The hat according to claim 7, wherein the flexible insert comprises:

a cutout in the flexible insert; and a plurality of fingers formed from a material of the flexible insert at the cutout for coaction to retain a wearer's head received in the cutout.

11. The hat according to claim 10, wherein the material of the flexible insert includes an inherent resiliency to receive and grip the wearer's head, and to return to its original position when the head is removed.

12. The hat according to claim 3, wherein the power means is adapted to rotate the screw-shaped ornament at a plurality of speeds.

* * * * *